US011167875B2

(12) United States Patent
Smith et al.

(10) Patent No.: US 11,167,875 B2
(45) Date of Patent: Nov. 9, 2021

(54) QUICK CLOSE SHIPPING CONTAINER

(71) Applicant: INTERNATIONAL PAPER COMPANY, Memphis, TN (US)

(72) Inventors: Jeffrey A. Smith, Medford, NJ (US); Jack Lawrence Lane, Memphis, TN (US); Joel Gregory Wisehart Phillips, Bentonville, AR (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/430,521

(22) Filed: Jun. 4, 2019

(65) Prior Publication Data

US 2020/0385162 A1 Dec. 10, 2020

(51) Int. Cl.

| | |
|---|---|
| ***B65D 5/02*** | (2006.01) |
| ***B65D 5/468*** | (2006.01) |
| ***B65D 5/06*** | (2006.01) |

(52) U.S. Cl.

CPC ..... *B65D 5/0254* (2013.01); *B65D 5/064* (2013.01); *B65D 5/4608* (2013.01)

(58) Field of Classification Search

CPC ..... B65D 5/0254; B65D 5/064; B65D 5/4608
USPC ..... 229/137–138, 140, 153, 117.16–117.17
See application file for complete search history.

(56) References Cited

U.S. PATENT DOCUMENTS

| | | | | |
|---|---|---|---|---|
| 2,797,041 | A * | 6/1957 | Rondone | B65D 5/5011 47/84 |
| 5,289,970 | A * | 3/1994 | McClure | B65D 5/0045 229/143 |
| 6,467,682 | B2 | 10/2002 | Toth et al. | |
| 6,668,525 | B2 | 12/2003 | Toth et al. | |
| 6,886,311 | B2 | 5/2005 | Toth et al. | |
| 6,951,530 | B2 | 10/2005 | Toth et al. | |
| 7,380,703 | B2 * | 6/2008 | Ogden | B65D 5/061 229/117.13 |
| 7,500,594 | B1 | 3/2009 | Toth et al. | |
| 2006/0091190 | A1 * | 5/2006 | Nikolai | B65D 5/46096 229/117.14 |
| 2015/0144688 | A1 * | 5/2015 | Bates | B65D 5/02 229/117.17 |

FOREIGN PATENT DOCUMENTS

| | | | | |
|---|---|---|---|---|
| FR | 2601332 | A1 * | 1/1988 | B65D 5/064 |
| GB | 2419582 | A * | 5/2006 | B65D 5/4204 |

* cited by examiner

*Primary Examiner* — Nathan J Newhouse
*Assistant Examiner* — Phillip D Schmidt
(74) *Attorney, Agent, or Firm* — Bradley T. Ligibel; Thomas W. Ryan

(57) ABSTRACT

A shipping container comprising first and second side panels, and first and second end panels connecting the first and second side panels. A pair of major upper flaps are foldably connected to respective side panels, the major upper flaps each forming half of a top panel. A pair of minor upper flaps are foldably connected to respective end panels, each of the minor upper flaps including a central tuck flap panel and a pair of gusset panels foldably connected to and overlapping the central tuck flap panel to form a tuck flap structure. Each tuck flap structure extending along an outer side of a respective end panel and including an end portion extending into an access port formed on the respective end panel.

6 Claims, 7 Drawing Sheets

QUICK CLOSE SHIPPING CONTAINER

FIELD OF THE INVENTION

The present invention relates to improvements in shipping containers and, more particularly, to a shipping container that can be erected and collapsed for reuse.

BACKGROUND OF THE INVENTION

Shipping containers are often used as returnable or reusable containers to deliver goods between two locations, such as may comprise reusable containers for delivering mixed goods between logistics distribution centers and stores. Such reusable containers must survive multiple trip cycles, each trip cycle typically including a set-up and collapse operation performed on the container as is it prepared for shipping to a store and subsequently returned to the distribution center.

In one configuration of a returnable shipper, a top flap closure comprising interlocking flaps can be provided, which has proven to be time consuming to fold and secure. Also, the interlocking structure typically includes locking features defined in the top flaps, such as die cut locking slots, that can weaken the container structure and can result in deformation of the container including, for example, nesting, sagging, and/or collapse of at least a portion of the container when it is stacked. Hence, there is a need for a reusable shipping container that can be easily erected and collapsed and that can provide a substantially secure structure that is resistant to nesting, sagging, and/or collapse when stacked.

SUMMARY OF THE INVENTION

In accordance with an aspect of the invention, a blank for making a shipping container is provided comprising opposing first and second longitudinal edges and opposing first and second lateral edges transverse to the longitudinal edges. A first panel, a second panel, a third panel, and a fourth panel are connected in series at respective first, second, and third vertical fold lines. An upper flap structure comprising first, second, third, and fourth upper flaps are foldably connected to respective ones of first, second, third, and fourth panels along an upper fold line extending longitudinally between the first and second longitudinal edges of the blank. Two of the upper flaps comprise lock flaps that define a tuck flap structure for engaging an access port on a respective adjacent panel. Each lock flap comprises first and second gusset fold lines extending in converging relation from opposing longitudinal edges of the adjacent panel to a lateral edge of the blank defining an outer edge of the lock flap. Each access port comprises an elongated slit portion located on the adjacent panel a distance from the upper fold line that is less than a distance from the upper fold line to the outer edge of a respective lock flap.

The first, second, third, and fourth flaps may be foldably connected in series at respective extensions of the first, second, and third vertical fold lines along the upper flap structure.

Each lock flap may comprise a generally triangular central tuck flap panel and generally triangular gusset panels connected to longitudinally opposing sides of the central tuck flap panel at the gusset fold lines.

The first and second gusset fold lines may be discontinuous fold lines including first and second fold line sections separated by a locking tab structure, the locking tab structure may include a pair of tabs defined by through cuts in each lock flap that extend outward from respective gusset fold lines.

Each gusset fold line may include a first fold line section having a first end intersecting the upper fold line and a second fold line section having a first end intersecting the outer edge of a respective lock flap, and wherein each through cut may extend from a second end of a respective first fold line section to a second end of a respective second fold line section.

The blank may include a tuck flap fold line extending longitudinally between the second ends of the first fold line sections.

The tuck flap fold line may be located a distance from the upper fold line that is approximately equal to the distance from the upper fold line to the access port.

The elongated slit portion of the access port may comprise first and second relatively narrow elongated slit sections extending longitudinally from opposing sides of a relatively larger central opening of the access port.

The blank may include a panel hand hole located on the adjacent panel between the upper fold line and the access port, and an upper flap hand hole located on each lock flap and located a distance from the upper fold line generally equal to a distance from the upper fold line to the panel hand hole.

The blank may include a pair of notches formed in each lock flap, extending inward at the outer edge of the lock flap, wherein the notches may be positioned to align on either side of both the panel hand hole and the upper flap hand hole when the blank is erected into a shipping container.

In accordance with another aspect of the invention, a shipping container is provided comprising first and second side panels, and first and second end panels connecting the first and second side panels. A pair of major upper flaps are foldably connected to respective side panels, the major upper flaps each forming half of a top panel. A pair of minor upper flaps are foldably connected to respective end panels, each of the minor upper flaps including a central tuck flap panel and a pair of gusset panels foldably connected to and overlapping the central tuck flap panel to form a tuck flap structure. Each tuck flap structure extending along an outer side of a respective end panel and including an end portion extending into an access port formed on the respective end panel.

Each minor upper flap may include edges that are connected to adjacent edges of each of the major upper flaps along fold lines.

Each tuck flap structure may include generally linear converging edges, and may include a pair of tabs extending outward of the converging edges for engagement with an inner surface of a respective end panel.

Each pair of tabs may be formed integrally with a respective central tuck flap panel.

The access port may comprise first and second relatively narrow elongated slit sections extending from opposing sides of a relatively larger central opening of the access port.

The blank may include a hand access opening defined by a panel hand hole through the end panel, an upper flap hand hole through the central tuck flap panel, and notches formed in the gusset panels and aligned with the panel hand hole and the upper flap hand hole.

The blank may include a cover flap foldably attached to an edge of each of the notches, each cover flap may extend across adjacent edges defining the panel hand hole and the upper flap hand hole of the end panel and the central tuck flap panel, respectively.

In accordance with a further aspect of the invention, a method of forming a shipping container from a blank is provided, the blank comprising opposing first and second longitudinal edges and opposing first and second lateral edges transverse to the longitudinal edges; a first end panel, a first side panel, a second end panel, and a second side panel connected in series at respective first, second, and third vertical fold lines, and the first end panel foldably connected to the second side panel; an upper flap structure comprising minor upper flaps foldably connected to respective end panels and major upper flaps foldably connected to respective side panels along an upper fold line extending longitudinally between the first and second longitudinal edges of the blank; each of the minor upper flaps defining a tuck flap structure, each tuck flap structure comprising a central tuck flap panel and gusset panels connected to opposing sides of the central tuck flap panel at first and second gusset fold lines extending in converging relation from opposing longitudinal edges of a respective end panel to a lateral edge of the blank defining an outer edge of the minor upper flap. The method comprises positioning the end and side panels to form a parallelepiped structure; folding the minor upper flaps outwardly, including pivoting the gusset panels into overlapping relation with a respective central tuck flap panel to form the tuck flap structure with converging edges; and engaging an end portion of each tuck flap structure through an access port in an adjacent end panel to retain the tuck flap structures in overlapping relation with outer sides of respective end panels.

The major upper flaps may be foldably connected to the minor upper flaps, and the major upper flaps may pivot inwardly to form a top panel simultaneously with folding the minor upper flaps outwardly.

The end portion of each tuck flap structure may comprise a pair of tabs extending outward of the converging edges, and engaging the end portions of the tuck flap structures through the access ports may position the tabs for engagement with an inner surface of a respective end panel.

Folding the minor upper flaps outwardly may position a hand hole formed in each central tuck flap panel in vertical alignment with a hand hole in a respective end panel.

Folding the minor upper flaps outwardly may further position notches formed in each gusset panel in vertical alignment with the hand holes in the respective end panel and central tuck flap panel.

A cover flap may be foldably attached to an edge of each of the notches, and each cover flap may be folded to extend across adjacent edges defining the hand holes in the respective end panel and central tuck flap panel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a container construction including a container that can be readily erected with mechanical connections between panels, while substantially avoiding use of adhesives, tape, or similar attachment mechanisms in order to facilitate reuse of the container by a customer. In particular, the container described herein can be readily erected for transporting goods as a non-palletized package on a truck from a distribution facility to another facility and collapsed for reuse, for example, by the distribution facility while substantially maintaining the integrity of the container for multiple uses.

Figure 1:
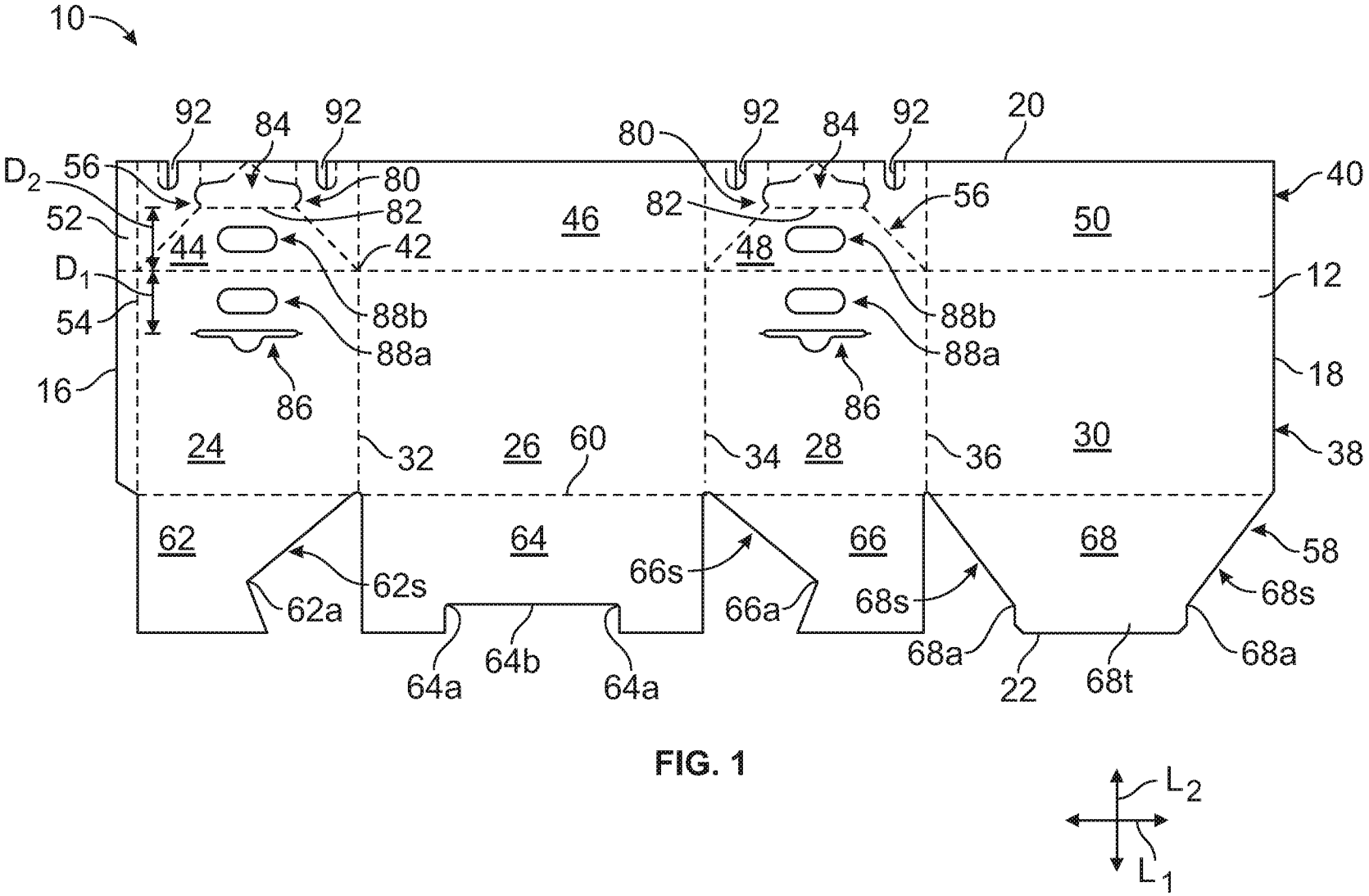
FIG. 1 is a plan view of a blank for forming a shipping container.
Figure 3:
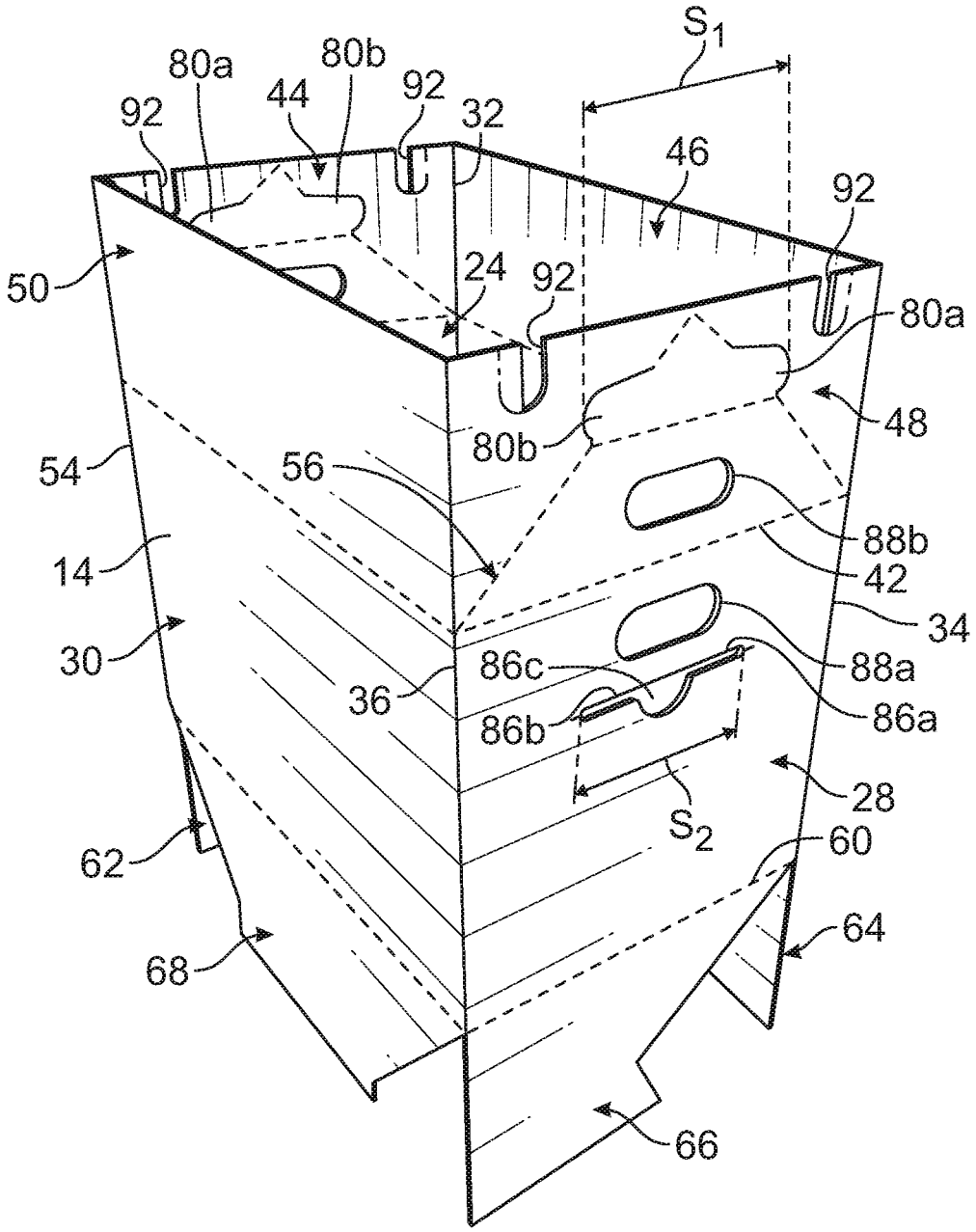
FIG. 3 is a perspective view of the blank of FIG. 1 formed into a parallelepiped structure for constructing a shipping container.

Referring to FIG. 1, a die cut blank 10 is shown for illustrating one or more aspects of the invention. In a use of the blank to form a one-piece container, the blank 10 may be formed of a corrugated cardboard material and may be die cut to the shape shown herein, although other materials and variations of the illustrated shape may be provided within the scope of the container described and claimed herein. The blank 10 illustrated in FIG. 1 is a planar piece of material in which an inner side 12 is shown facing out of the page and an outer side 14, see FIG. 3, is facing in an opposite direction from the inner side 12.

As seen in FIG. 1, the blank 10 extends in a longitudinal direction $L_1$ between opposing first and second longitudinal edges, generally designated 16 and 18, respectively, and further extends in a lateral direction $L_2$, between first and second lateral edges 20, 22, generally designated 20 and 22, respectively, and extending transverse to the longitudinal edges 16, 18.

First, second, third, and fourth panels, comprising a first end panel 24, a first side panel 26, a second end panel 28, and a second side panel 30, are foldably connected in series to form a main body 38. The first end panel 24 is connected to the first side panel 26 at a first vertical fold line 32, the first side panel 26 is connected to the second end panel 28 at a second vertical fold line 34, and the second end panel 28 is connected to the second side panel 30 at a third vertical fold line 36.

An upper flap structure 40 is foldably connected to the main body 38 along an upper fold line 42 extending longitudinally between the first and second longitudinal edges 16, 18 of the blank 10. In particular, the upper flap structure 40 includes a first upper flap 44 foldably connected to the first end panel 24, a second upper flap 46 foldably connected to the first side panel 26, a third upper flap 48 foldably connected to the second end panel 28, and a fourth upper flap 50 foldably connected to the second side panel 30. The first upper flap 44 is foldably connected to the second upper flap 46 along an extension of the first vertical fold line 32, the second upper flap 46 is foldably connected to the third upper flap 48 along an extension of the second vertical fold line 34, and the third upper flap 48 is foldably connected to the fourth upper flap 50 along an extension of the third vertical fold line 36. Further, a glue tab 52 is foldably connected to the first end panel 24 and the first upper flap 44 along a glue tab fold line 54 and, in a construction of a container 8 formed by the blank 10, see FIG. 9, the glue tab 52 can be adhered or attached to the fourth panel 30 and the fourth upper flap 50 at a manufacturer's joint, such that first end panel 24 and the first upper flap 44 are foldably attached to the fourth panel 30 and the fourth upper flap 50, respectively, along the glue tab fold line 54. Hence, the upper flaps 44, 46, 48, 50 can be continuously connected in series without slots extending laterally into the upper flap structure 40.

It may be noted that in the illustrated embodiment, the first and third upper flaps 44, 48 define minor flaps, and the second and fourth upper flaps 46, 50 define major flaps. Further, in a construction of a container 8 formed by the blank 10, the major flaps defined by the second and fourth upper flaps 46, 50 form an upper panel 98 of the container 8, see FIG. 9, and the minor flaps defined by the first and third upper flaps 44, 48 form lock flaps comprising tuck flap structures 56 that can releasably retain or lock the major flaps 46, 50 in a closed position forming the upper panel 98 of the container 8, as is described in greater detail below.

Referring to FIG. 1, the blank further includes a bottom flap structure 58 foldably connected to the main body 38 along a lower fold line 60 extending longitudinally between the first and second longitudinal edges 16, 18 of the blank 10. In particular, the bottom flap structure 58 includes a first bottom flap 62 foldably connected to the first end panel 24, second bottom flap 64 foldably connected to the first side panel 26, a third bottom flap 66 foldably connected to the second end panel 28, and a fourth bottom flap 68 foldably connected to the second side panel 30.

Figure 8:
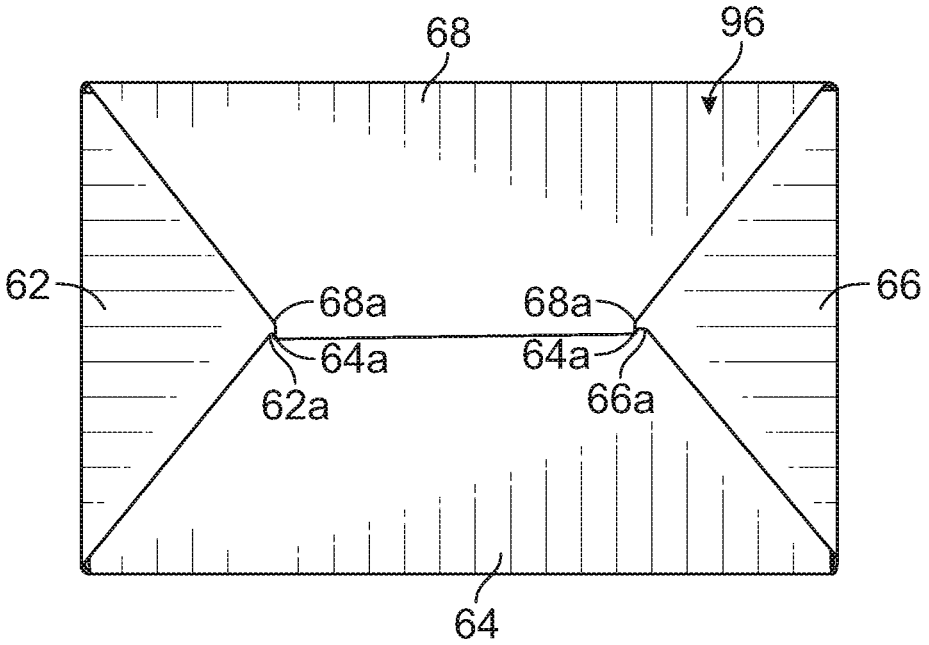
FIG. 8 is a bottom view of the shipping container showing the bottom flaps folded to form a bottom panel of the container.

The first bottom flap 62 includes a generally L-shaped longitudinal side 62*s* defining a side corner 62*a* facing toward the second bottom flap 64, and the third bottom flap 66 similarly includes a generally L-shaped longitudinal side 66*s* defining a side corner 66*a* facing toward the second bottom flap 64. The second bottom flap 64 includes an elongated notch 64*b* extending inward form an outer edge defined at the second lateral edge 22 and defining a pair of notch corners 64*a*. The fourth bottom flap 68 has opposing sides 68*s* and a distal tab 68*t*, wherein the opposing sides 68*s* converge toward each other and intersect the tab 68*t* at corners 68*a*. The bottom flaps 62, 64, 66, 68 may be folded together to form a bottom panel 96 of the container 8, see FIG. 8, as is described in further detail below.

Figure 2:
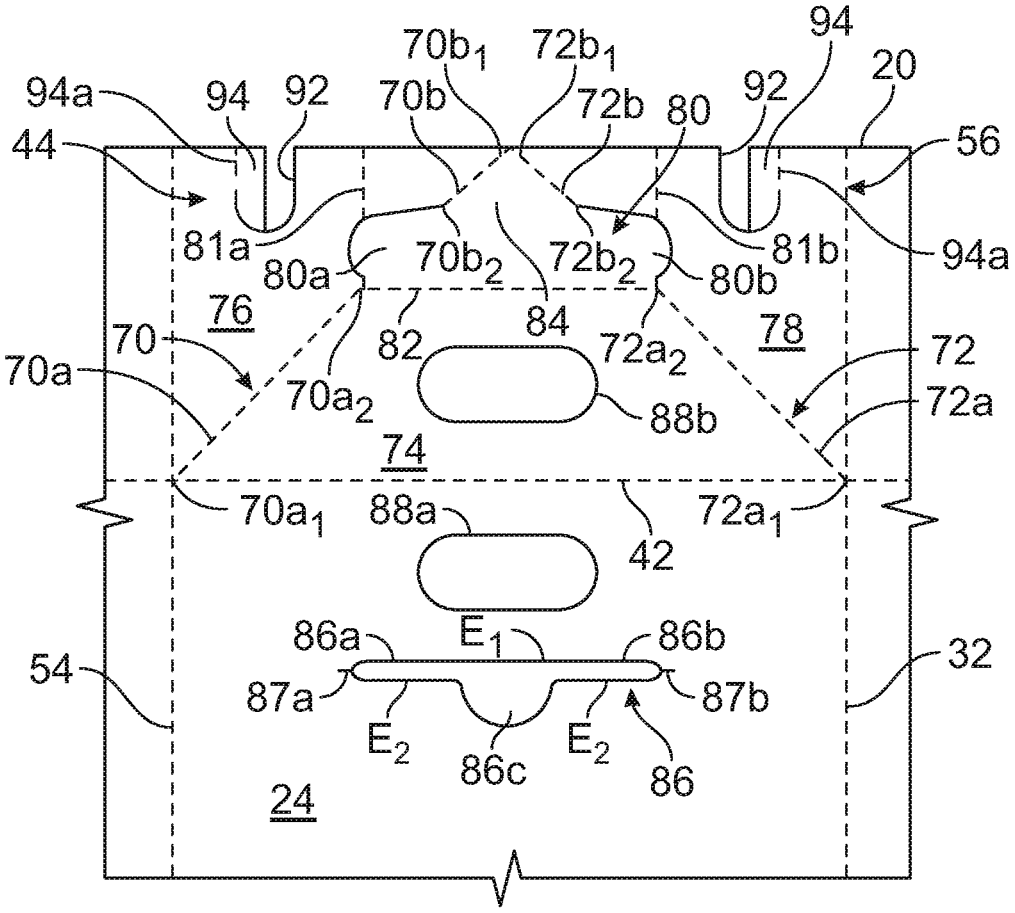
FIG. 2 is an enlarged plan view of a tuck flap structure shown in FIG. 1.

As noted above, the first and third upper flaps 44, 48 can define a tuck flap structure 56 for maintaining the container 8 in a closed condition. Referring to FIG. 2, a tuck flap structure 56 typical of either of the first and third upper flaps 44, 48, and associated cooperating structure defined on respective end panels 24, 28, is illustrated and described herein with particular reference to the tuck flap structure 56 on the first upper panel 44 and cooperating structure on the first end panel 24. The tuck flap structure 56 includes first and second gusset fold lines 70, 72 extending in converging relation from opposing longitudinal edges of the end panel 24, i.e. at the opposing fold lines 54, 32 on the end panel 24, to the first lateral edge 20 of the blank 10 defining an outer edge of the lock flap.

The gusset fold lines 70, 72 divide the lock flap defined by the first upper flap 44 into a generally triangular central tuck flap panel 74, and generally triangular first and second gusset panels 76, 78 foldably connected to opposing longitudinal sides of the central tuck flap panel 74. The first and second gusset fold lines 70, 72 are discontinuous fold lines, wherein the first gusset fold line 70 includes first and second fold line sections 70*a*, 70*b*, and the second gusset fold line 72 includes first and second fold line sections 72*a*, 72*b*. The first fold line sections 70*a*, 72*a* are separated from the respective second fold line sections 70*b*, 72*b* by a locking tab structure 80, the locking tab structure including first and second tabs 80*a*, 80*b* formed integral with the central tuck flap panel 74 and defined by through cuts in the first upper flap 44 that extend outward from respective gusset fold lines 70, 72.

The first fold line section 70*a* of the first gusset fold line 70 includes a first end $70a_1$ intersecting the upper fold line 42 and a second end $70a_2$ adjacent to the first tab 80*a*, and the second fold line section 70*b* of the first gusset fold line 70 includes a first end $70b_1$ intersecting the outer edge 20 of first end flap 44 and a second end $70b_2$ adjacent to the first tab 80*a*, wherein the through cut defining the first tab 80*a* extends from the second end $70a_2$ of the first fold line section 70*a* to the second end $70b_2$ of the second fold line section 70*b*. Similarly, the first fold line section 72*a* of the second gusset fold line 72 includes a first end $72a_1$ intersecting the upper fold line 42 and a second end $72a_2$ adjacent to the second tab 80*b*, and the second fold line section 72*b* of the second gusset fold line 72 includes a first end $70b_1$ intersecting the outer edge 20 of first end flap 44 and a second end $72b_2$ adjacent to the second tab 80*b*, wherein the through cut defining the second tab 80*b* extends from the second end $72a_2$ of the first fold line section 72*a* to the second end $72b_2$ of the second fold line section 72*b*. As illustrated herein, the tabs 80*a*, 80*b* are each defined as convexly curved portions extending longitudinally outward from the respective gusset fold lines 70, 72.

A tuck flap fold line 82 extends between the second ends $70a_2$, $72a_2$ of the first fold line sections 70*a*, 72*a* and defines an end portion 84 of the tuck flap structure 56 extending from the tuck flap fold line 82 to the lateral edge 20. The first end panel 24 includes an access port 86 comprising an elongated slit portion that is located to receive the end portion 84 when the tuck flap structure 56 is pivoted about the upper fold line 42. That is, a distance $D_1$ from the upper fold line 42 to the access port 86 is less than a distance from the upper fold line 42 to the outer edge of the first upper flap 44 and, more particularly, the distance $D_1$ may be generally equal to a distance $D_2$ from the upper fold line 42 to the tuck flap fold line 82, see FIG. 1.

The fold lines defining the tuck flap structure 56 may comprise cut-crease lines. In particular, the upper fold line 42 at the first upper flap 44, the gusset fold lines 70, 72 and the tuck flap fold line 82 may comprise cut-crease lines, any or all of which could comprise a perforated line defined by a cut line that extends completely or partially through the material and which is interrupted by a series of short sections of bridging (uncut) material.

The elongated slit portion of the access port 86 is defined by an upper edge $E_1$, and elongated side edges $E_2$ spaced from and parallel to the upper edge $E_1$ to define first and second relatively narrow elongated slit sections 86*a*, 86*b* extending longitudinally from opposing sides of a relatively larger central opening 86*c*. The central opening 86*c* is depicted herein as a semicircular cutout that extends below the elongated side edges $E_2$ and may have a length in the longitudinal direction that is approximately equal to the length of each of the slit sections 86*a*, 86*b*, although alternative relative lengths may be provided for the central opening 86*c* and slit sections 86*a*, 86*b*. The configuration and size of the central opening 86*c* facilitates passage of the end portion 84 of the tuck flap structure 56 into the access port 86, such as to facilitate angling the end portion 84 into the interior of the container 8 between the contents in the container 8 and the adjacent end panel 24, 28. It may be understood that alternative configurations of the access port 86, i.e., alternative configurations of the central opening 86*c* and/or the slit sections 86*a*, 86*b*, may be provided for receiving the tuck flap end portion 84 therein.

The blank 10 can further include features to facilitate handling the container 8. With further reference to FIG. 2, the first end panel 24 includes a hand hole 88*a*, which may be a conventional oval shaped hand hole. The first upper flap 44 includes a similarly shaped hand hole 88*b* that is spaced from the upper fold line 42 a distance that is substantially equal to a distance from the upper fold line 42 to the hand hole 88*a*, such that the upper flap hand hole 88*b* is substantially vertically aligned with the panel hand hole 88*a* when the when the tuck flap structure 56 is pivoted about the upper fold line 42, to form a continuous through hole defining a container hand hole 88.

Further, a pair of notches 92 are formed in the first upper flap 44, extending inward from the outer edge 20 of the first upper flap 44. The notches 92 are positioned to align on either side of both the panel hand hole 88*a* and the upper flap hand hole 88*b* when the blank 10 is erected into a shipping container 8. The notches 92 each include a cover flap 94 that is connected to an edge of a respective notch 92 along a cover flap hinge line 94*a* to permit the cover flap 94 to pivot inward through the hand holes 88*a*, 88*b* when the blank 10 is erected into a shipping container 8, as is described further below.

As noted above, the tuck flap structure 56 described in detail with reference to the first upper flap 44 and the respective adjacent first end panel 24 is typical of the tuck flap structure 56 provided to the third upper flap 48 and the respective adjacent second end panel 28. Hence, a substantially identical tuck flap structure 56 can be provided to each of the first and third upper flaps 44, 48 for cooperating with substantially identical structure provided to each of the respective end panels 24, 28.

Figure 7:
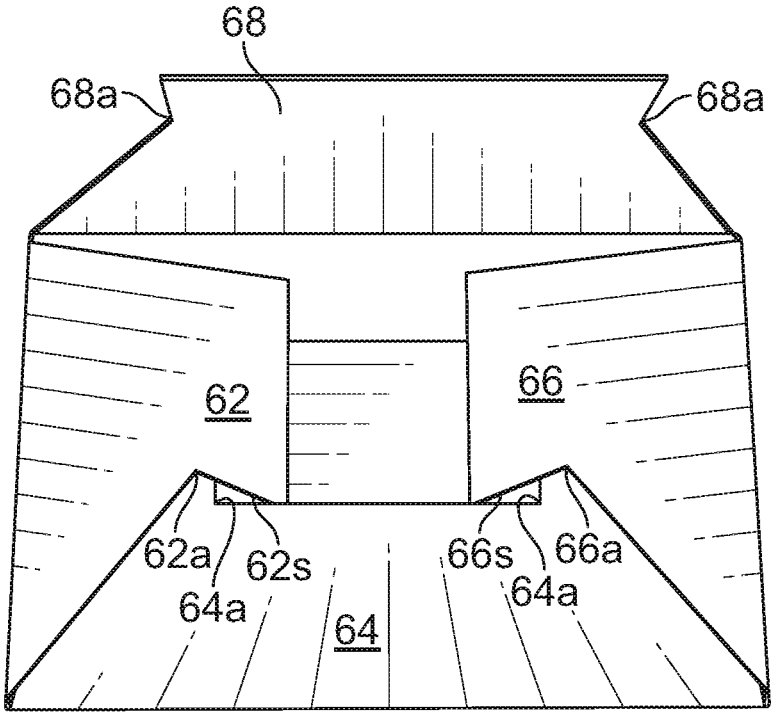
FIG. 7 is a bottom view of the shipping container showing partially folded bottom flaps of the container.

In a process of erecting the container 8 from the blank 10, a manufacture's joint may initially be formed by folding the blank about the second vertical fold line 34 to attach the glue tab 52 to the fourth panel 30. Subsequently, the end panels 24, 28 can be positioned parallel to each and the side panels 26, 30 can be positioned parallel to each other to form a parallelepiped structure as seen in FIG. 3. A bottom panel 96, see FIG. 8, can be formed by folding the bottom flaps 62, 64, 66, 68 together. In particular, as seen in FIG. 7, the second bottom flap 64 can be folded inward, and the first and third bottom flaps 62, 66 can be folded inward to position distal edges of the longitudinal sides 62*s*, 66*s* behind the second bottom flap 64, locating the side corners 62*a*, 66*a* in engagement with respective notch corners 64*a*. The fourth bottom flap 68 can then be folded inward to position the tab 68*t* behind the second bottom flap 64, locating the corners 68*a* adjacent to the side corners 62*a*, 66*a* and notch corners 64*a*, see FIG. 8.

Figure 4:
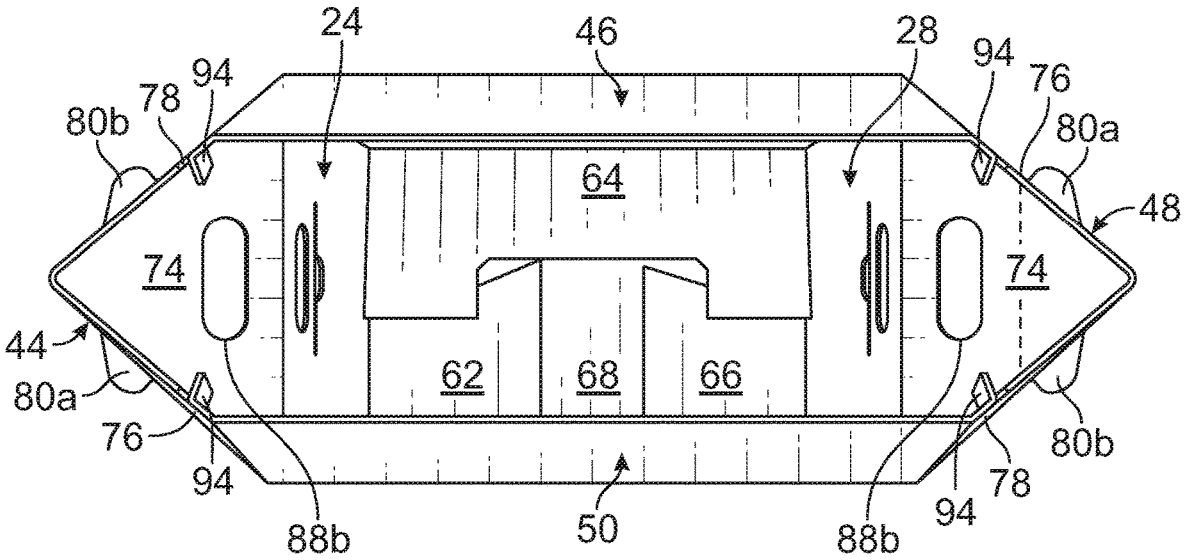
FIG. 4 is a top view of a shipping container formed from the blank of FIG. 1 including partially folded upper flaps.
Figure 5:
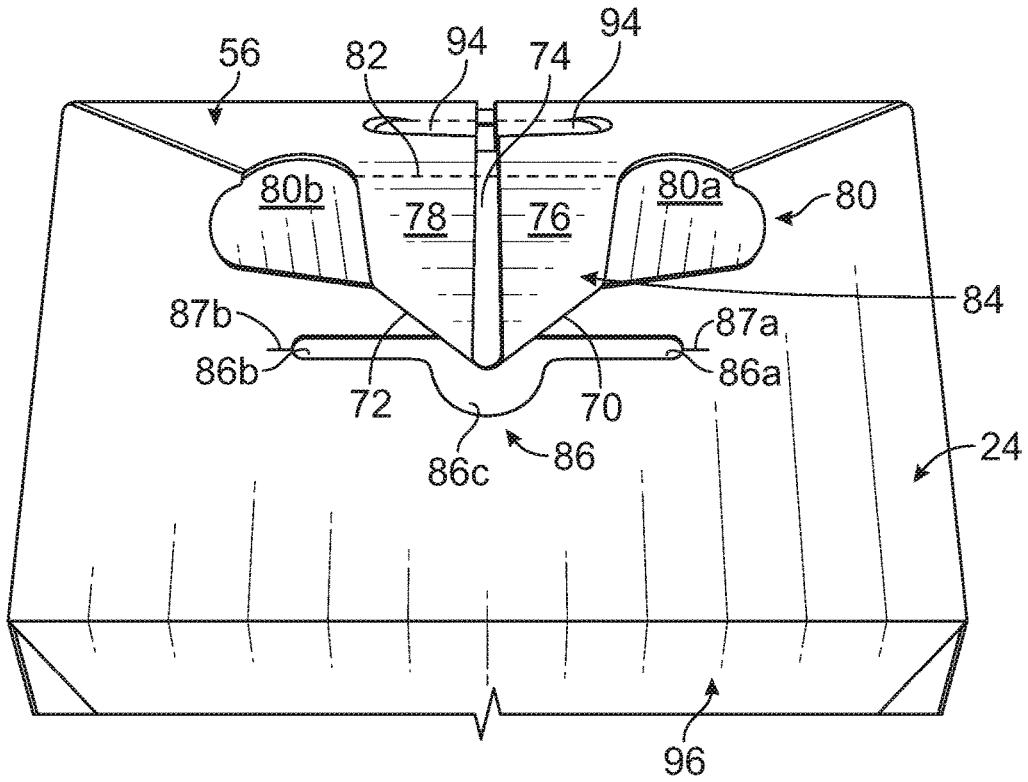
FIG. 5 is an end view of the shipping container showing a tuck flap structure prior to engagement with an access port.
Figure 9:
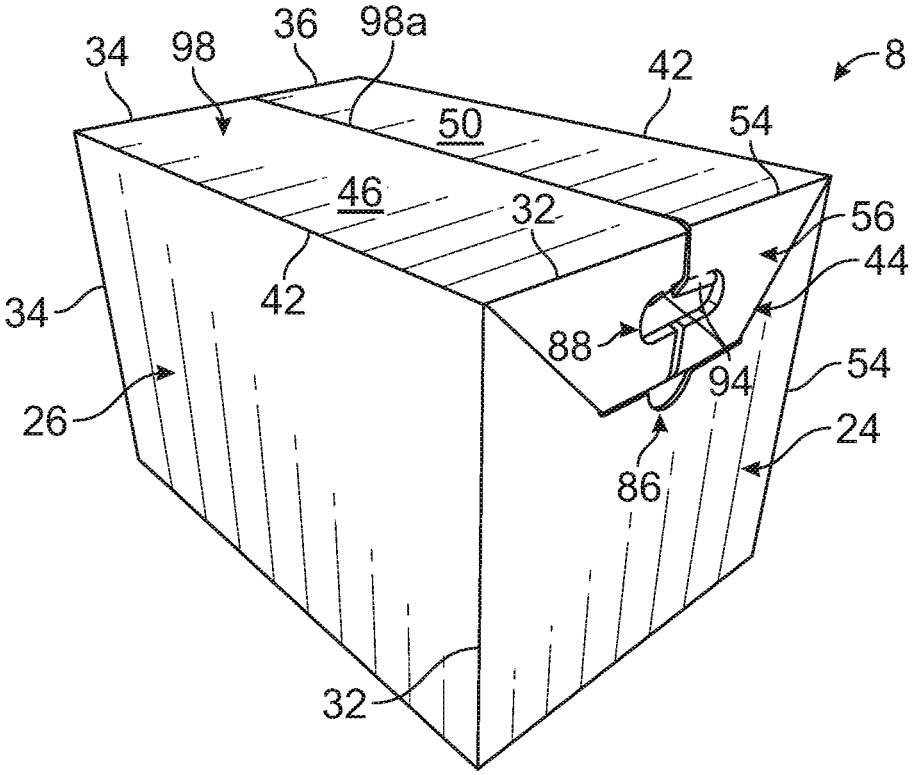
FIG. 9 is a perspective view of an erected shipping container formed from the blank of FIG. 1.

Subsequent to formation of the bottom panel 96, goods (not shown) may be placed in the container 8 and the upper flap structure 40 may be folded to form a top panel 98, see FIG. 9. Referring to FIGS. 4 and 5, the top panel 98 can be formed by folding or pivoting the first and third upper flaps 44, 48 outward about the upper fold line 42, resulting in the gusset panels 76, 78 pivoting inward into overlapping relation with a respective central tuck flap panel 74, and forming the tuck flap structure 56 with converging edges defined by the gusset fold lines 70, 72. As the gusset panels 76, 78 pivot inward with outward pivoting of the first and third upper flaps 44, 48, the second and fourth upper flaps 46, 50 are simultaneously pivoted inward to form the top panel 98, wherein the second and fourth upper flaps 46, 50 each form half of the top panel 98 and meet to form a seam 98*a* extending centrally along the top panel 98, see FIG. 9.

Figure 6:
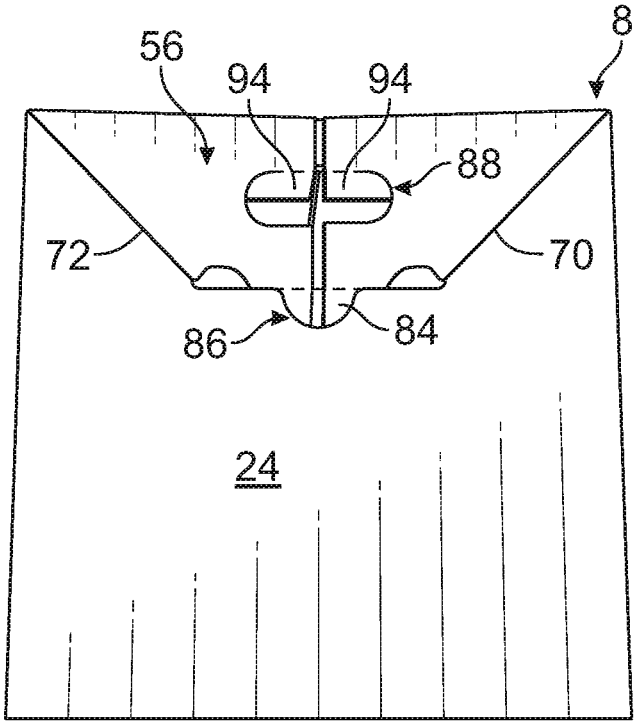
FIG. 6 is an end view of the shipping container showing the tuck flap structure engaged in the access port.

Referring to FIG. 5, the end portion 84 of each tuck flap structure 56 can be folded about the tuck flap fold line 82 to direct the end portion 84 inward toward a respective end panel 24, 28 and direct an outer end of the tuck flap structure 56 into the access port 86. To facilitate bending of the end portion 84, fold lines 81*a*, 81*b*, see FIG. 2, may also be provided on the respective gusset panels 76, 78 and positioned to overlap the tuck flap fold line 82 when the gusset panels 76, 78 are folded over the central tuck flap panel 74. To accommodate passage of the folded structure of the end portion 84, it may be understood that the elongated side edges $E_2$ may be spaced from the upper edge $E_1$ a distance at least equal to or slightly greater than the combined thickness of the central panel 74 and overlapping gusset panels 74, 76. It may be noted that the enlarged central opening 86*c* provides a clearance to facilitate entry of the tuck flap structure 56 into the container 8 at a downward angle to minimize interference with the goods packed inside. As the end portion 84 of the tuck flap structure 56 is inserted further into the access port 86, the tabs 80*a*, 80*b* pass through the elongated slit sections 86*a*, 86*b* to position the tabs within the container 8 and in abutting engagement with an interior surface of the respective end panel 24, 28, see FIG. 6. In this position, the tuck flap structures 56 extend down along outer sides of the respective end panels 24, 28.

It should be noted that the span $S_1$ of the tab structure 80, as measured between the outermost edges of the tabs 80*a*, 80*b*, is greater than the span $S_2$ of the access port 86, as measured between the outermost edges of the elongated slit sections 86*a*, 86*b*, see FIG. 3. Hence, once the tab structure 80 is inserted through the access port 86, the tabs 80*a*, 80*b* operate to retain the tuck flap structure 56 engaged within the access port 86. Passage of the tab structure 80 through the access port 86 may be facilitated by through cuts 87*a*, 87*b* extending longitudinally outward from the respective elongated slit sections 86*a*, 86*b*, as seen in FIG. 2

It may be noted that the gusseted tuck flap structure 56 provides a connection between the two halves of the top panel 98, i.e., between the upper flaps 46, 50, that enables folding the upper flaps 46, 50 to a secure closed position in one continuous motion, wherein additional fastener mechanisms, e.g., tape, glue and/or slotted top panel connections, are not required. Further, providing the tuck flap structures 56 secured or locked in place against the outside of the respective end panels 24, 28 operates to position the fold line connections between the gusset panels 76, 78 and the second and fourth upper flaps 46, 50, as defined at the upper flap fold line extensions 32, 34, 36, 54 that lie across the upper fold line 42 at opposing ends of the container 8, to facilitate maintaining the upper flaps 46, 50 in tension against stacking forces. Hence, the connection of the tuck flap structures 56 to the upper flaps 46, 50, i.e., via the gusset panels 76, 78, forms the top panel 98 as a substantially secure structure that is resistant to nesting, sagging, and/or collapse when stacked.

Further, positioning the tuck flap structures 56 in overlapping engagement along the outside of the respective end panels 24, 28 positions the hand holes 88*a*, 88*b* to form the container hand hole 88. To provide additional comfort to the user and structural strength in the area of the hand hole 88, the cover flaps 94 can be folded, as seen in FIG. 9, to extend inward across upper edges of the hand holes 88*a*, 88*b*, wherein three layers of material are provided at the hand hole 88 comprising the end panel 24, 28, the central tuck flap panel 74, and the gusset panels 76, 78.

The described container 8 also provides a readily collapsible construction that can enable the container 8 to be reused multiple times. For example, after the container 8 is shipped to a delivery destination and unpacked, the tabs 80*a*, 80*b* can be extracted back though the access port 86 to unlock the tuck flap structure 56 from the end panels 24, 28 and permit the upper flaps 44, 46, 48, 50 to be pivoted parallel to the main body panels 24, 26, 28, 30. Further, the bottom flaps 62, 64, 66, 68 can be unfolded from engagement with each other and pivoted parallel to the main body panels 24, 26, 28, 30. The container 8 can then be collapsed to a flat configuration for return, for example, to the packing and shipping location.

Figure 10:
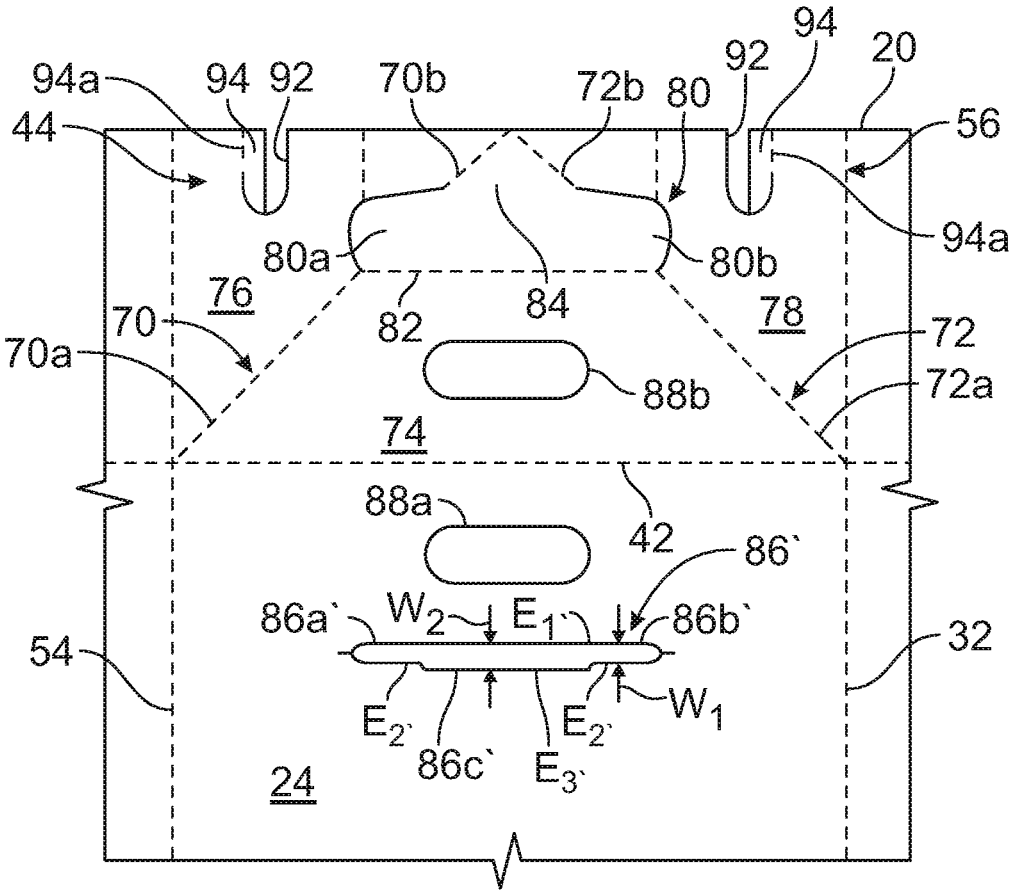
FIG. 10 is an enlarged plan view of the tuck flap structure including an alternative configuration for an access port for receiving an end portion of the tuck flap structure.

Referring to FIG. 10, an alternative configuration for the access port is depicted as access port 86', wherein the elements illustrated for the tuck flap structure 56 are substantially the same as is described for the tuck flap structure in FIG. 2 and can be provided on the blank 10 described with reference to FIG. 1. For the purposes of this description, the access port 86' is shown on the end panel 24, wherein it may be understood that a similar access port can be provided on the end panel 28.

The access port 86' can comprise an elongated slit portion defined by an upper edge $E_1'$, and elongated side edges $E_2'$ spaced from and parallel to the upper edge $E_1'$ to define first and second relatively narrow elongated slit sections 86*a*', 86*b*' extending longitudinally from opposing sides of a relatively larger central opening 86*c*'. The central opening 86*c*' is defined by an elongated central edge $E_3'$ extending parallel to the upper edge $E_1'$ to define a slit area having a vertical width $W_2$ that is greater than a vertical width $W_1$ defined by the first and second slit sections 86*a*', 86*b*' to form a stairstep configuration between the first and second slit sections 86*a*', 86*b*' and the central opening 86*c*'. For example, the width $W_2$ of the central opening 86*c*' generally may be 40-50% greater than the width $W_1$ defined by the first and second slit sections 86*a*', 86*b*', and more particularly may be about 42% greater than the width $W_1$ defined by the first and second slit sections 86*a*', 86*b*'. The alternative configuration provided by the central opening 86*c*' can facilitate angling the end portion 84 into the interior of the container 8 between the contents in the container 8 and the adjacent end panel 24, 28, and additionally providing frictional contact surfaces at the edges $E_1'$ and $E_3'$ engaged with the surfaces of the end portion 84 of the tuck flap structure 56 to facilitate retention of the end portion 84 within the access port 86'. It may also be noted that FIG. 10 illustrates a modification to the hand holes 88*a*, 88*b*. The illustrated modification shows hand holes 88*a*, 88*b* with a reduced vertical dimension which can improve the strength of the end panel structures, such as to provide increased resistance to premature false creasing and collapse of the container 8 in the area of the end panel structures.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shipping container comprising:

first and second side panels;

first and second end panels connecting the first and second side panels;

a pair of major upper flaps foldably connected to respective side panels, the major upper flaps each forming half of a top panel;

a pair of tabs extending outward of the converging edges for engagement with an inner surface of a respective end panel;

a pair of minor upper flaps foldably connected to respective end panels, each of the minor upper flaps including a central tuck flap panel and a pair of gusset panels foldably connected to and overlapping the central tuck flap panel to form a tuck flap structure;

each tuck flap structure including generally linear converging edges defined along fold lines, each fold line connecting the central tuck flap panel and an adjacent gusset panel and extending from a fold line between a respective end panel and the central tuck flap panel; and each tuck flap structure extending along an outer side of a respective end panel and including an end portion extending into an access port formed on the respective end panel.

2. The shipping container as set forth in claim 1, wherein each minor upper flap includes edges that are connected to adjacent edges of each of the major upper flaps along fold lines.

3. The shipping container as set forth in claim 1, wherein each pair of tabs is formed integrally with a respective central tuck flap panel.

4. The shipping container as set forth in claim 1, wherein the access port comprises first and second relatively narrow elongated slit sections extending from opposing sides of a relatively larger central opening of the access port.

5. The shipping container as set forth in claim 1, including a hand access opening defined by a panel hand hole through the end panel, an upper flap hand hole through the central tuck flap panel, and notches formed in the gusset panels and aligned with the panel hand hole and the upper flap hand hole.

6. The shipping container as set forth in claim 5, including a cover flap foldably attached to an edge of each of the notches, each cover flap extending across adjacent edges defining the panel hand hole and the upper flap hand hole of the end panel and the central tuck flap panel, respectively.

* * * * *